United States Patent [19]

Seilo

[11] 4,273,642

[45] Jun. 16, 1981

[54] ELECTROLYTIC CELL

[75] Inventor: Matti Seilo, Harjavalta, Finland

[73] Assignee: Outokumpu Oy, Helsinki, Finland

[21] Appl. No.: 85,632

[22] Filed: Oct. 17, 1979

[30] Foreign Application Priority Data

Oct. 17, 1978 [FI] Finland ..... 783156

[51] Int. Cl.[3] ..... C25B 9/00; C25B 9/02

[52] U.S. Cl. ..... 204/286; 204/288; 204/289

[58] Field of Search ..... 204/286, 288, 289

[56] References Cited

U.S. PATENT DOCUMENTS 745,412 12/1903 Blackman ..... 204/286

1,267,653 5/1918 Gillis ..... 204/286

4,134,806 1/1979 De Nora et al. ..... 204/284

*Primary Examiner*—R. L. Andrews

*Attorney, Agent, or Firm*—Brooks, Haidt, Haffner & Delahunty

[57] ABSTRACT

An electrolytic cell, especially for the oxidation of nickel (II) hydroxide, having a container for the electrolyte as well as anodes and cathodes fitted overlappingly at short distances from each other and connected to a source of current by means of lugs, which the anodes and the cathodes are supported by the container bottom and the lugs of the anodes and the lugs of the cathodes have been offset in relation to each other.

2 Claims, 7 Drawing Figures

Fig. 2b
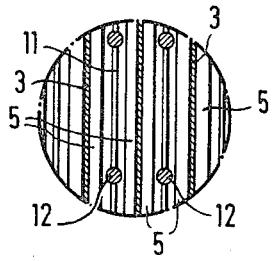
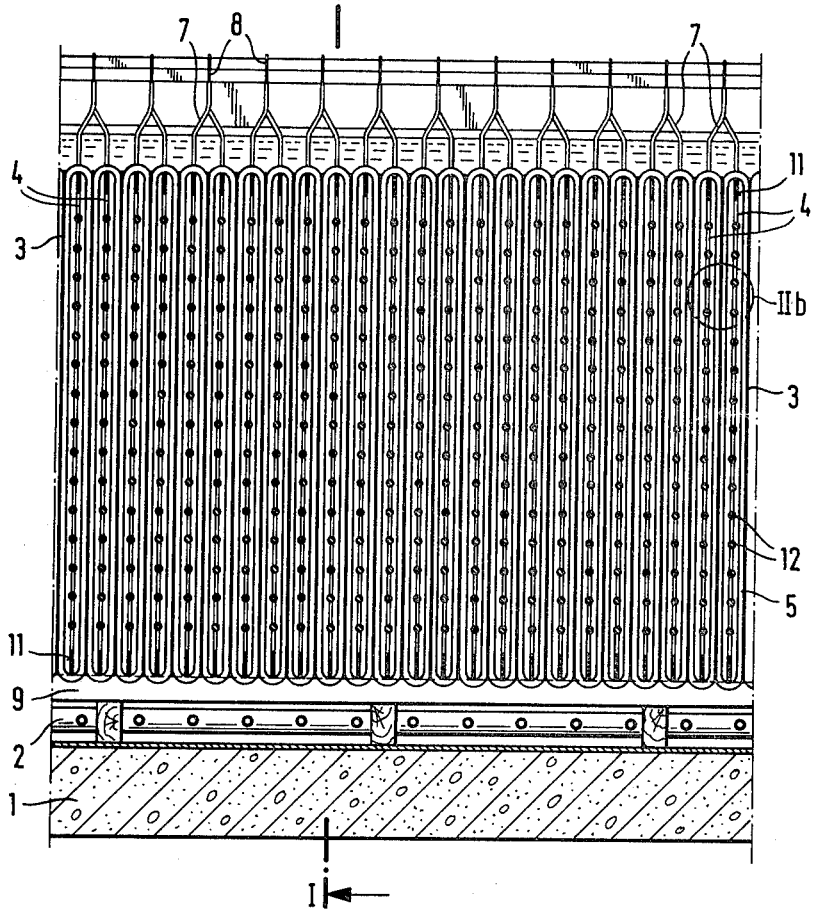
Fig. 2a

ELECTROLYTIC CELL

BACKGROUND OF THE INVENTION

The present invention relates to an electrolytic cell and in particular to an electrolytic cell of the type used for the oxidation of nickel (II) hydroxide, having a container for the electrolyte, as well as anodes and cathodes fitted at a short distance from each other overlappingly and connected to a source of power by means of lugs.

The oxidation of nickel (II) hydroxide to nickel (III) hydroxide requires a considerably high oxidation potential, but it can be performed using certain chemicals such as per-sulfate, chlorine an ozone, or electrolytically in an oxidization cell suited for this purpose.

Often the oxidized product, nickel (III) hydroxide, is further used for the oxidation and precipitation of impurities such as cobalt, iron, manganese, lead, arsenic, selenium and bismuth from electrolytic solutions, for example a nickel electrolyte.

The oxidizing capacity of nickel (III) hydroxide is, of course, better when the degree of oxidation from the initial product is higher. In practice it has been observed that the oxidation can be carried out beyond the stage of nickel (III) hydroxide, in which case the product also includes nickel (IV) compounds. The oxidizing capacity of such a product is especially high.

The oxidation of nickel (II) hydroxide to nickel (III) hydroxide by means of chemicals is not always advantageous. A few reasons for this are given below:

Effective chemicals are expensive and their use usually requires a stoichiometric excess if the aim is a product in which the oxidation has been carried out at least to a degree of oxidation corresponding to nickel (III) hydroxide.

The use of chemicals may be detrimental to other operations within the process; they can, for example, accumulate in the process or corrode the apparatus.

The degree of oxidation achieved in a nickel hydroxide precipitate by using inexpensive chemicals (e.g. a gas mixture of oxygen and sulfur dioxide) is usually low, and in this case its oxidizing capacity is not high.

The electrolytic oxidation of nickel (II) hydroxide can be performed without adding any detrimental chemical to the process. When using the prior known techniques, however, the current efficiency of the electric energy used has been only 15–20% when the oxidation has been carried out to the nickel (III) hydroxide. The present invention relates to a new electrolytic cell by means of which nickel (III) hydroxide can be prepared in such a manner that the efficiency of the current used is many times higher than the previous one.

In an electrolytic oxidation process the hydroxide particle being oxidized behaves in accordance with Reaction (1):

$$Ni(OH)_2 + H_2O \rightleftharpoons Ni(OH)_3 + H^+ + e^- \quad (1)$$

Since a $Ni(OH)_2$ particle is electrically neutral externally, it does not behave in the electrolyte in the same way as ions. The particle to be oxidized is brought to the anode surface by mixing the solution/solid suspension by a compressed-air blast, for example.

An anode reaction (2)

$$2H_2O \rightleftharpoons O_2(g) + 4H^+ + 4e^- \quad (2)$$

useless in terms of the final result competes with reaction (1).

In this case, whether or not oxidizing particles can be brought to the anode surface in the quantity required by the consumption of power is crucial for Reaction (1). In other cases Reaction (2) occurs as the anode reaction.

Considering the final result, it is therefore important that the particles being oxidized have a high chance of meeting the anode surface. This chance is created when in the oxidation cell there is a maximal anodic surface area in proportion to the hydroxide particles present in the suspension and when the mixing is advantageous in terms of the movement of the particles.

In previously known electrolytic cells the electrodes have been suspended from electrode arms, along which electricity is also conducted to the electrodes. In practice such a technique limits the placing of the electrodes close to each other without producing short-circuits during the electrolysis owing to the electrode arms and the bolt attachment of the electrodes extending through the arms. By careful use of this technique only 25–30 $m^2$ of anodic surface area is obtained per one cubic meter of the hydroxide suspension to be oxidized.

The object of the present invention is therefore to provide an electrolytic cell in which the electrode surface area/tank volume ratio is higher than previously and thereby the current efficiency of the electrolytic cell is higher than previously.

SUMMARY OF THE INVENTION

In the electrolytic cell according to the invention, the anodes and the cathodes have been fitted closer to each other than previously by having the anodes and cathodes rest on the tank bottom and by offsetting the lugs of the anodes and the lugs of the cathodes in relation to each other, in which case the anode lug and the cathode lug are advantageously on opposite sides of their respective electrode. The anodes and the cathodes rest advantageously on supports made of an electric insulating material on the bottom of the cell container.

In order to achieve maximally good mixing in the electrolytic cell according to the invention, special-structured cathodes are used in it. These cathodes are frames with several wires strung between their sides one on top of the other at a distance from each other. They preferably have vertical pipes or bars made of an electric insulating material in order to separate the cathode from the anodes on both its sides. Such a cathode structure allows a maximally hindrance-free movement of the particles in the electrolytic solution.

Under the electrodes at the bottom of the electrolytic cell there has been, furthermore, fitted an air-mixing pipe system known per se, by means of which the electrolytic solution is mixed.

DESCRIPTION OF THE DRAWINGS

FIG. 2*a* illustrates a longitudinal section of part of a preferred enbodiment of the invention;

FIG. 2*b* is a partial representation of FIG. 2*a* on a larger scale;

DESCRIPTION OF THE PREFERRED EMBODIMENT

Figure 1:
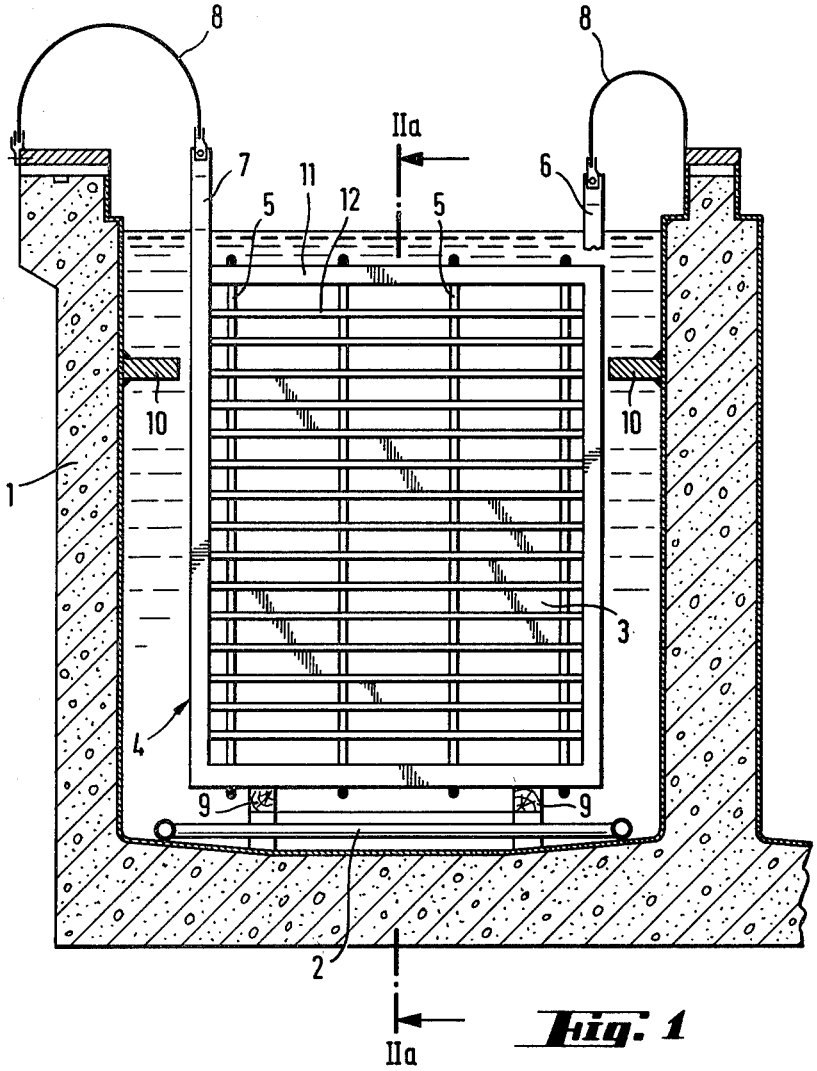
FIG. 1 depicts a cross section of the electrolytic cell according to the invention, sectioned at the cathode.

In the accompanying drawings the electrolytic tank is indicated by 1, the air-mixing pipe system fitted at the floor of the electrolyte container 1 is indicated by 2, the anodes and cathodes are indicated by 3 and 4, the plastic pipes or bars separating the cathode 4 from the anodes 3 on each of its sides are indicated by 5, the lugs of the anodes 3 and the cathodes 4 are indicated by 6 and 7, the cable by which the lugs 6 and 7 of the electrodes have been connected to a source of current are indicated by 8, the supports of the electrodes are indicated by 9, the electrode guides are indicated by 10, the cathode frame is indicated by 11 and the cathode wire by 12.

As seen in FIG. 1, the electrodes 3, 4 have been fitted in the electrolytic cell container 1 to rest on supports 9 fitted at its bottom. At the floor of the electrolytic tank there has also been fitted an air-mixing pipe system 2, by means of which the hydroxide suspension is mixed in a conventional manner. On the side walls of the container 1 there are, furthermore, guides 10 for the electrodes 3, 4. The electrodes have been fitted in the container 1 to rest on supports 9 in such a manner that the lugs 6 of the anodes and the lugs 7 of the cathodes are on opposite sides of the electrolytic cell container, and the lugs 6, 7 have been connected to a source of current by current conductors 8.

The electrolytic cell shown in FIG. 1 has been sectioned along the cathode. In the enbodiment depicted in FIG. 1 the cathode consists of a frame 11, an upward-directed lug 7 attached to one upper edge of the frame, and cathode wires 12 strung between the vertical sides of the frame 11 at a distance from each other one above the other.

Figure 3:
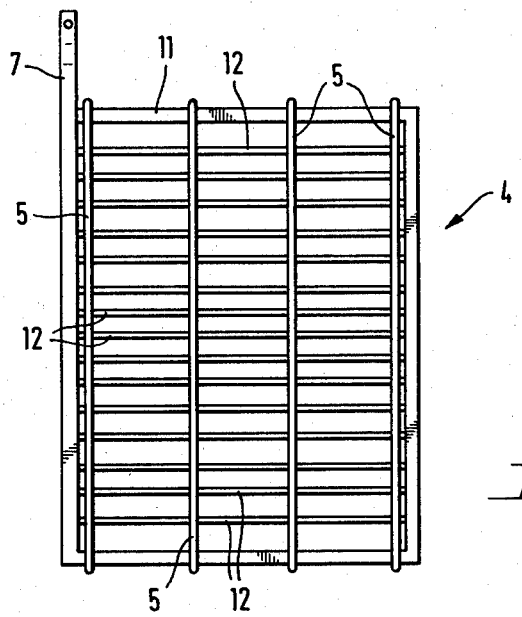
FIG. 3 is a side view of a cathode used in the electrolytic cell of FIG. 2*a* and FIG. 4 is a side view of an anode used in the electroylic cell of FIG. 2*a*.

In the enbodiment depicted in FIGS. 2*a* and 2*b* the cathodes 4, the structure of which is shown in more detail in FIG. 3, have also been fitted with plastic pipes or bars 5 which, extending vertically on each side of the cathode and separating the electrodes, minimally prevent the mixing and flow of the hydroxide suspension between the electrodes.

Figure 4:
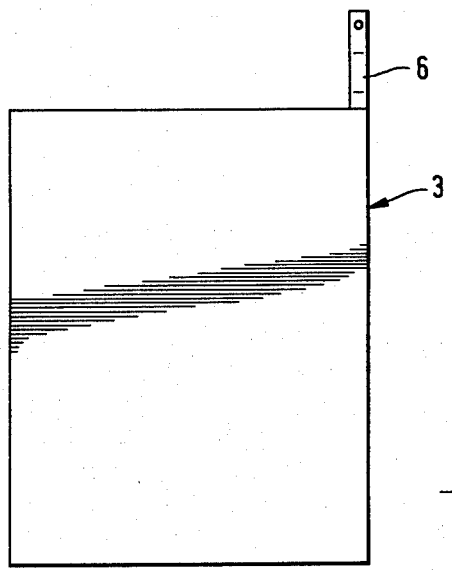

As seen in FIG. 4, the anode is a simple rectangular plate with an upward-directed lug 6 attached or formed at one of its upper corners.

As seen in FIG. 2*a*, several cathodes 4 or respectively anodes 3 can be attached to the same current conductor 8.

By placing the electrodes as close to each other as possible, the resistance caused by the electrolyte to the flow of electric current is reduced and thereby the energy economy of oxidation is improved.

The invention is described below in more detail with the aid of examples and with reference to FIG. 5, which is a graph showing the dependence of the current efficiency on the anode surface area/suspension volume ratio, and FIG. 6, which depicts the dependence of the cell voltage on the density of the current.

EXAMPLE 1

In the laboratory-scale oxidation cells according to FIG. 2*a-b*, with volumes of 1.70, 3.75 and 15.0, oxidation experiments were performed in which the ratio of the anodic surface area to the suspension volume varied within 135–29 $m^2/m^3$. The anode/cathode surface area ratio was approx. 11. The anode material was approx. 1 mm thick nickel plate and the wire cathodes were A1S1 316 steel.

The experiments were performed at 20° C. The suspension to be oxidized contained nickel (II) hydroxide 30 g/l, sodium sulfate 50 g/l and sodium hydroxide 10 g/l. The suspension was mixed in the tank by a compressed-air blast.

The oxidation experiments were performed as batch experiments and were terminated when the nickel hydroxide had oxidized to at least nickel (III) hydroxide. Anode current densities of 10, 20, 30, 50 and 70 $A/m^2$ were used in each cell.

Figure 5:
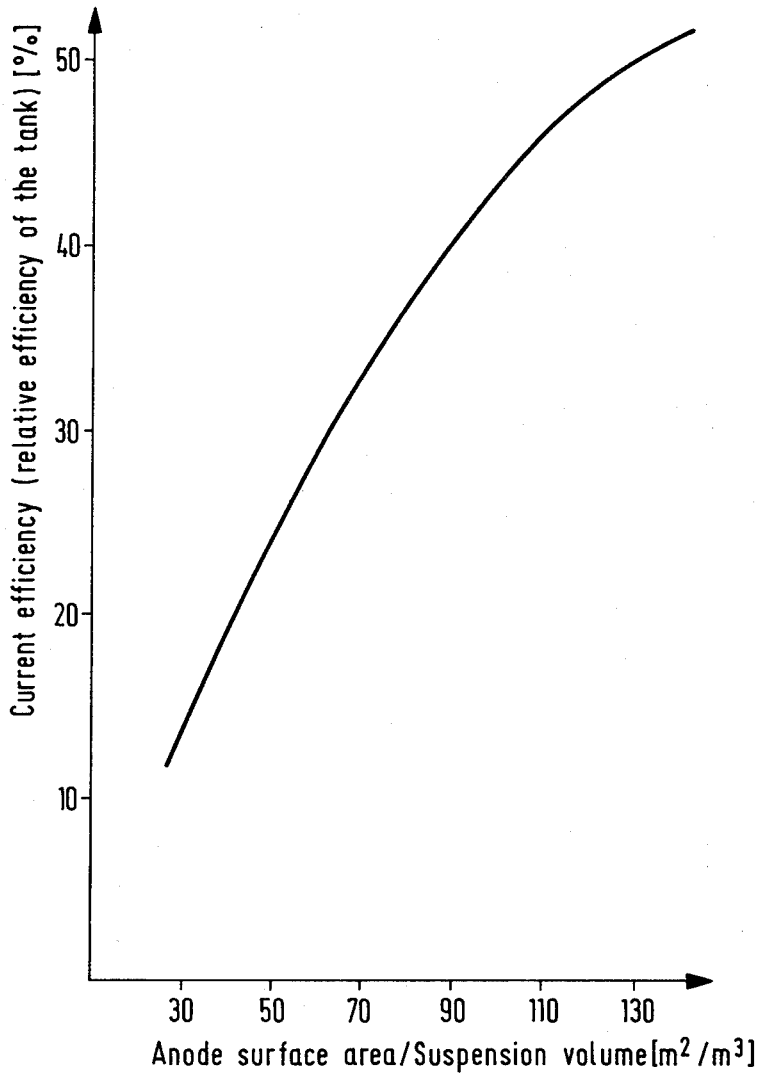

FIG. 5 depicts the current efficiency, calculated on the basis of oxidation experiments, as a function of the anode surface area/suspension volume ratio. The change in the anode surface area/suspension volume ratio has been obtained by increasing the anode surface area in the tank, whereby, the current being constant, the current density respectively declines. The current efficiency values have been calculated at a moment at which the nickel (II) has been entirely converted to nickel (III).

Figure 6:
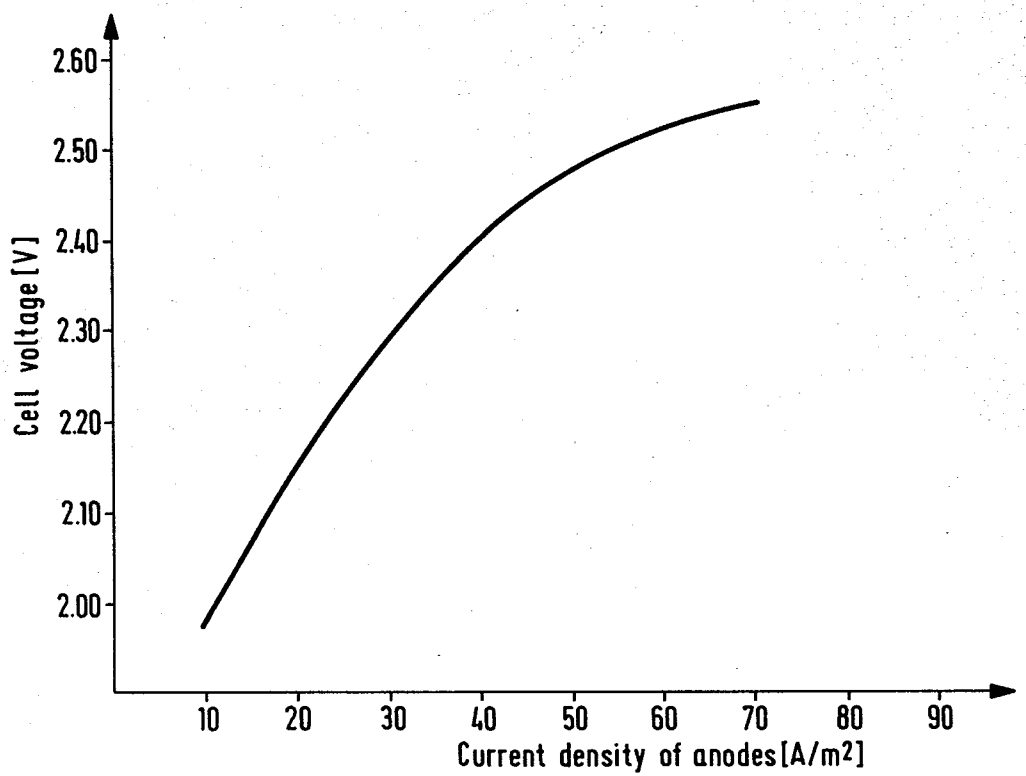

FIG. 6 depicts the dependence of the cell voltage of the oxidation cell on the current density.

When interpreting the results shown in the graphs, it can be observed that increased anode surface area strongly improves the current efficiency and at the same time lowers the cell voltage.

EXAMPLE 2

Two experiments were performed on an industrial scale, shifting gradually to the use of the advantages offered by the invention in question.

During the first stage the anode surface area/suspension volume ratio was increased from a conventional value of 25 $m^2/m^3$ to 42 $m^2/m^3$, in which case, according to results obtained over a trail period of four months, the current efficiency of the oxidation tank in question was 30%, whereas the current efficiency of a conventional tank used for reference wass respectively 15%. The degree of oxidation in the products of the experimental and reference oxidation tanks was the same, corresponding to nickel (III) hydroxide. The nickel (III) hydroxide production of the experimental tank was thus double that of the reference tank.

The improvement of the current efficiency corresponds quite precisely to the results obtained in laboratory experiments, taking into consideration the differences of level between the experiments performed on the laboratory scale and the industrial scale.

During the next stage a tank structure according to the invention was taken into use, having an anode surface area/suspension volume ratio of 72 $m^2/m^3$. The current efficiency improved almost exactly in accordance with FIG. 5. In addition, it could be observed that the placement of the electrodes in the tank considerably more compactly than previously did not complicate the mixing by means of compressed air, and even on the industrial scale this did not create the risk of shortcircuits.

Using the structure according to the invention, it is possible to obtain an anode surface area/suspension volume ratio of 100 $m^2/m^3$. Thereby, owing to the increase in the current efficiency and the decrease in the tank voltage, the energy costs of oxidation drop to 20% of the previous cost. Considerable savings are also achieved in capital investment. If the production of the oxidation tank quadruples over the previous one, the desired production is achieved with only one-fourth of the number of oxidation tanks required previously.

What is claimed is:

1. An electrolytic cell, comprising: a container for electrolyte having a bottom and side walls; a plurality of vertical platelike electrodes in spaced mutually parallel relationship, said electrodes being supported at a distance from each other on the bottom of the container; a lug attached to the upper part of each electrode such that the position thereof is offset in relation to the lugs of each adjacent electrode; an external source of current having two poles; and means for connecting each second electrode to one pole and the electrode therebetween to the other pole; each second electrode connected to said one pole comprising an electrically conducting frame with said lug attached thereto; attached to said frame a plurality of spaced, separated and substantially parallel electrically conducting wires extending from one side of the frame to the opposite side; and attached to said frame vertically extending means of an electrically insulating material on both sides of said electrode for separating the electrodes from each other.

2. The electrolytic cell of claim 1 wherein the electrodes connected to said other pole are plates with said lug extending from the upper part of one of the plate side edges.

* * * * *